US009621973B2

(12) United States Patent
Stauber et al.

(10) Patent No.: US 9,621,973 B2
(45) Date of Patent: Apr. 11, 2017

(54) WEARABLE AUDIO DEVICE

(71) Applicant: Samsung Electronics Company, Ltd., Suwon, Gyeong gi-Do (KR)

(72) Inventors: Mark Stauber, Palo Alto, CA (US); Olivier Bau, San Francisco, CA (US); Junyeon Cho, San Jose, CA (US); Gabriel Reyes, Atlanta, GA (US)

(73) Assignee: Samsung Electronics Company, Ltd, Suwon (KR)

( * ) Notice: Subject to any disclaimer, the term of this patent is extended or adjusted under 35 U.S.C. 154(b) by 90 days.

(21) Appl. No.: 14/634,012

(22) Filed: Feb. 27, 2015

(65) Prior Publication Data

US 2016/0088380 A1 Mar. 24, 2016

Related U.S. Application Data

(60) Provisional application No. 62/053,718, filed on Sep. 22, 2014.

(51) Int. Cl.

| | |
|---|---|
| ***H04R 25/00*** | (2006.01) |
| ***H04R 1/02*** | (2006.01) |
| ***H04R 3/04*** | (2006.01) |
| ***G10K 11/02*** | (2006.01) |

(52) U.S. Cl.

CPC ..... *H04R 1/02* (2013.01); *G10K 11/02* (2013.01); *H04R 3/04* (2013.01); *G10K 2210/1081* (2013.01); *G10K 2210/3229* (2013.01); *H04R 2460/01* (2013.01); *H04R 2460/13* (2013.01)

(58) Field of Classification Search

CPC ..... H04R 25/606; H04R 2460/13

USPC ..... 381/151

See application file for complete search history.

(56) References Cited

U.S. PATENT DOCUMENTS

| | | | | |
|---|---|---|---|---|
| 5,737,433 | A | 4/1998 | Gardner | |
| 6,178,251 | B1 | 1/2001 | Luchs | |
| 6,456,721 | B1 | 9/2002 | Fukuda | |
| 6,721,433 | B2 | 4/2004 | Sato | |
| 6,891,286 | B2 | 5/2005 | Flanagan | |
| 8,150,075 | B2 | 4/2012 | Abolfathi | |
| 8,638,966 | B2 | 1/2014 | Taylor | |
| 2004/0062411 | A1* | 4/2004 | Retchin | H04R 1/1066 381/376 |
| 2004/0146172 | A1 | 7/2004 | Goswami | |

(Continued)

FOREIGN PATENT DOCUMENTS

| | | |
|---|---|---|
| JP | 2001-116602 | 4/2001 |
| JP | 2011-130334 | 6/2011 |
| JP | 5629831 | 11/2014 |

*Primary Examiner* — Paul S Kim
*Assistant Examiner* — Katherine Faley
(74) *Attorney, Agent, or Firm* — Baker Botts L.L.P.

(57) ABSTRACT

In one embodiment, a device includes at least one transducer configured to vibrate within a first frequency range to generate a signal audible by a wearer of the device. The device includes the first material, which has an acoustic impedance at one or more frequencies within the first frequency range that is substantially similar to an acoustic impedance of the wearer's skin at the one or more frequencies. The device includes a second material that has an acoustic impedance at one or more frequencies within the first frequency range that substantially differs from an acoustic impedance of an environment of the device.

35 Claims, 5 Drawing Sheets

(56) References Cited

U.S. PATENT DOCUMENTS

| | | | | |
|---|---|---|---|---|
| 2004/0156012 | A1* | 8/2004 | Jannard | G02C 11/06 351/158 |
| 2004/0183690 | A1* | 9/2004 | Nakagawa | H04R 25/606 340/4.11 |
| 2005/0129257 | A1* | 6/2005 | Tamura | H04R 17/00 381/151 |
| 2005/0207599 | A1 | 9/2005 | Fukumoto | |
| 2006/0215844 | A1* | 9/2006 | Voss | H04R 25/70 381/60 |
| 2007/0223724 | A1* | 9/2007 | Miyazaki | H04R 3/00 381/77 |
| 2008/0219458 | A1* | 9/2008 | Brooks | H03G 3/32 381/57 |
| 2008/0240461 | A1* | 10/2008 | Nakamura | H04R 5/023 381/81 |
| 2009/0052709 | A1* | 2/2009 | Smith | H04R 25/02 381/328 |
| 2009/0175478 | A1 | 7/2009 | Nakajima | |
| 2010/0172519 | A1* | 7/2010 | Kimura | H04R 1/1008 381/151 |
| 2010/0317913 | A1* | 12/2010 | Conn | A61N 1/36032 600/25 |
| 2013/0051585 | A1* | 2/2013 | Karkkainen | H04R 1/1075 381/151 |
| 2013/0142348 | A1 | 6/2013 | Weisman | |
| 2013/0324043 | A1 | 12/2013 | Kassayan | |
| 2013/0329918 | A1 | 12/2013 | Kubba | |
| 2014/0112503 | A1 | 4/2014 | Hebenstreit | |
| 2014/0185837 | A1 | 7/2014 | Kunimoto | |
| 2014/0241540 | A1 | 8/2014 | Hodges | |

* cited by examiner

WEARABLE AUDIO DEVICE

RELATED APPLICATION(S)

This application claims the benefit, under 35 U.S.C. §119(e), of U.S. Provisional Patent Application No. 62/053,718, filed 22 Sep. 2014, which is incorporated herein by reference.

TECHNICAL FIELD

This disclosure generally relates to wearable audio devices.

BACKGROUND

Personal audio listening is most commonly accomplished through headphones, headsets, earbuds etc. that require the user to put something in or on the ear. This is an invasive way to listen compared to how one listens naturally with nothing covering the ear. Personal audio listening device may also involve wires coming from the headset that can be a nuisance, and there are challenges to keeping listening device in place on or in the ear when playing sports or being active. In addition, headsets occlude the ear from other environmental sounds making headset listening incompatible with other activities such as driving, work settings, and anything that requires attention to sounds from the environment. The duration for which personal audio devices can be worn may be limited due to the health risks of prolonged sound exposure, discomfort, or the need to hear sound from the outside environment.

DESCRIPTION OF EXAMPLE EMBODIMENTS

Figure 1A:
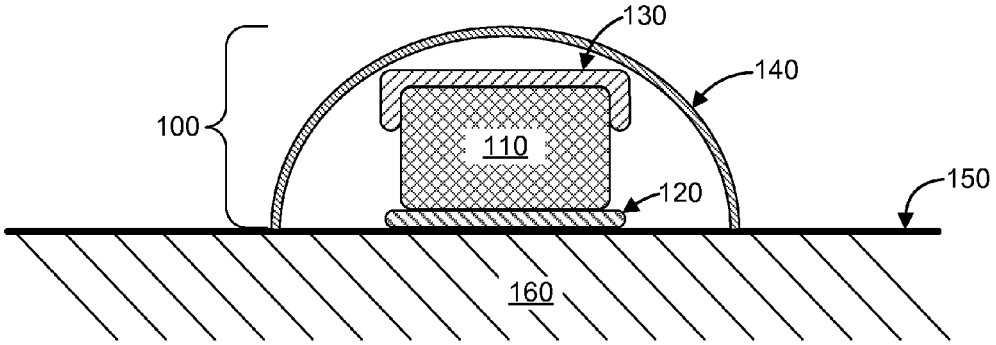
FIGS. 1A and 1B each illustrate a cross-sectional view of an example transducer assembly.
Figure 1B:
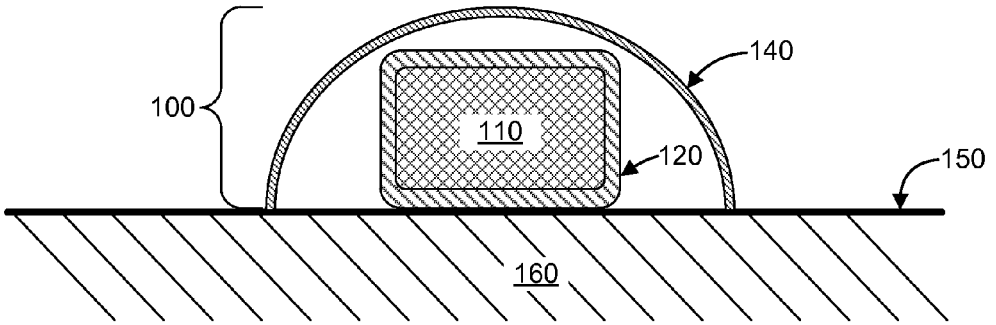

FIGS. 1A and 1B each illustrate a cross-sectional view of an example transducer assembly 100. In the example of FIGS. 1A and 1B, a portion of transducer assembly 100 is in contact with a person's outer layer of skin 150. In particular embodiments, transducer assembly 100 may generate an acoustic signal and mechanically couple the acoustic signal to skin layer 150 at an area where transducer assembly 100 contacts skin layer 150. The acoustic signal may then propagate through a portion of a person's body 160. As an example and not by way of limitation, transducer assembly 100 may be configured to generate an acoustic signal that is coupled to a wrist area of a person's body. The acoustic signal may then propagate through the person's arm, and a portion of the acoustic signal may reach the person's ears where it is perceived or heard by the person as a sound, such as for example, a beep, a click, a tone, music, a person's voice, or any other suitable sound. In particular embodiments, transducer assembly 100 may be referred to as a transducer. In particular embodiments, a wearable audio device may include one or more transducer assemblies 100, where each transducer assembly 100 is configured to be in contact with a person's skin and transmit an acoustic signal into the person's body. A portion of the acoustic signal from each transducer assembly 100 of a wearable audio device may propagate through the person's body to one or both of the person's ears where a sound corresponding to the acoustic signal may be heard by the person wearing the audio device.

In particular embodiments, transducer assembly 100 may include transducer 110. In particular embodiments, transducer 110 may be an electroacoustic device configured to receive an electrical drive signal that causes a portion of transducer 110 to mechanically move, vibrate, or oscillate. The movement, vibration, or oscillation (which may be used interchangeably herein, as appropriate) of transducer 110 may produce an acoustic signal based on the electrical drive signal. As an example and not by way of limitation, an acoustic signal produced by transducer 110 may match or be related to one or more frequency, amplitude, or phase characteristics of a driving electrical signal. When transducer 110 is in contact with a portion of skin 150 of a person's body 160, an acoustic signal may be coupled to the person's skin 150 and into the person's body 160. Transducer 110 may be referred to as an actuator, an acoustic transducer, an audio transducer, an ultrasonic transducer, a piezoelectric transducer, or an ultrasonic piezoelectric transducer.

In particular embodiments, transducer 110 may be a piezoelectric-based device, a magnetostriction-based device, a capacitive transducer, or any other suitable type of transducer. As an example and not by way of limitation, transducer 110 may be a piezoelectric transducer which includes a piezoelectric material that changes size when an electric voltage is applied to the material. By applying an electrical drive signal at a particular frequency or range of frequencies to piezoelectric transducer 110, a portion of piezoelectric transducer 110 can be made to move or oscillate at the drive frequency or frequencies. As an example and not by way of limitation, applying a 1-kHz electrical drive signal to transducer 110 may cause a portion of transducer 110 to mechanically vibrate at 1 kHz, and transducer 110 may then produce a 1-kHz acoustic signal. With a portion of transducer assembly 100 in contact with skin layer 150, the 1-kHz acoustic signal may be mechanically coupled into a person's body where a portion of the signal may propagate to the person's ears, causing the person to hear a 1-kHz tone. As another example and not by way of limitation, by applying, to transducer 110, an electrical drive signal having a particular frequency range (e.g., a 10 Hz to 20 kHz range corresponding to an audible signal), transducer 110 may produce an acoustic signal having a similar frequency range. Although this disclosure describes and illustrates particular transducer assemblies having particular types of transducers, this disclosure contemplates any suitable transducer assemblies having any suitable types of transducers and any suitable number of transducers. In particular embodiments, a transducer assembly may include more than one type of transducer.

In particular embodiments, an acoustic signal may refer to a mechanical wave of pressure and displacement that propagates through a material or a combination of materials. As an example and not by way of limitation, an acoustic signal may propagate through air, water, skin 150, or a person's body 160. As another example and not by way of limitation, an acoustic signal may be coupled into a person's body 160 by vibration of a portion of transducer 110 in contact with skin layer 150, and the acoustic signal may propagate through a combination of skin 150, muscle, fat, blood, or bone. In particular embodiments, an acoustic signal may be referred to as an audio signal, an audible signal, an acoustic wave, sound, a sound wave, or an ultrasonic signal.

In particular embodiments, an acoustic signal generated by transducer 110 may be composed of any suitable acoustic frequency or range or combination of acoustic frequencies. In particular embodiments, an acoustic signal generated by transducer assembly 100 may be composed of acoustic frequencies in an audible frequency range (e.g., from approximately 10 Hz to approximately 20 kHz), where an audible frequency refers to a frequency that can be heard or perceived by a human ear. As an example and not by way of limitation, an acoustic signal produced by transducer 110 and configured to transmit a person's voice (e.g., for a phone conversation) may have a frequency range from approximately 20 Hz to approximately 3 kHz. As another example and not by way of limitation, an acoustic signal produced by transducer 110 and configured to transmit music may have a frequency range from approximately 20 Hz to approximately 16 kHz. As another example and not by way of limitation, an acoustic signal for transmitting a notification (e.g., a beep, a click, or a tone) may have a central frequency of approximately 2 kHz with a bandwidth or range of approximately 200 Hz about the 2-kHz central frequency.

In particular embodiments, an acoustic signal generated by transducer 110 may be composed of acoustic frequencies in an ultrasonic frequency range (e.g., ≥20 kHz), where an ultrasonic frequency (or, ultrasound frequency) refers to a frequency greater than a maximum frequency that can be heard or perceived by a human ear. As an example and not by way of limitation, transducer 110 may produce an acoustic signal in an ultrasonic range of frequencies (e.g., between 20 kHz and 100 kHz, between 36 kHz and 44 kHz, or between any suitable range of ultrasonic frequencies). As another example and not by way of limitation, transducer 110 may produce an ultrasonic signal that includes an audible signal combined or mixed with a carrier frequency, such as for example a 40 kHz carrier frequency. For example, a 40 kHz carrier signal may be amplitude modulated by a music signal, and the resulting amplitude-modulated acoustic signal may have a frequency range of approximately 30 kHz to 50 kHz. As another example and not by way of limitation, a 40 kHz carrier signal may be amplitude modulated by a voice signal, and the resulting amplitude-modulated acoustic signal may have a frequency range of approximately 38 kHz to 42 kHz. In particular embodiments, an acoustic signal generated by transducer assembly 100 may have an acoustic frequency range in any suitable combination of audible or ultrasonic frequency ranges. As an example and not by way of limitation, transducer 110 may produce an acoustic signal over any suitable range of frequencies that may include audible frequencies, ultrasonic frequencies, or any suitable combination thereof (e.g., between 20 Hz and 100 kHz or between 10 kHz and 50 kHz). Although this disclosure describes and illustrates particular transducers configured to produce particular acoustic signals having particular frequency ranges, this disclosure contemplates any suitable transducers configured to produce any suitable acoustic signals having any suitable frequency ranges.

In particular embodiments, an acoustic signal generated by transducer 110 may have similar frequency, amplitude, or phase characteristics of a corresponding audio signal. As an example and not by way of limitation, an audio signal representing a person's voice may have a particular frequency range (e.g., 20 Hz to 3 kHz) and a particular frequency spectrum that represents the relative strength or amplitude of the various frequency components. An acoustic signal corresponding to the 20 Hz-3 kHz audio signal may have a similar frequency range and a similar frequency spectrum. In particular embodiments, an acoustic signal generated by transducer assembly 100 may be a modulated, mixed, or transformed version of a corresponding audio signal and may have different frequency, amplitude, or phase characteristics from the audio signal. As an example and not by way of limitation, an acoustic signal may be an amplitude-modulated version of an input audio signal that is produced by mixing the audio signal with a carrier signal (e.g., a 40 kHz carrier signal). In particular embodiments, an acoustic signal may be based on an amplitude modulation, frequency modulation, phase modulation, or any suitable signal-modulation scheme applied to an input audio signal. In particular embodiments, an acoustic signal may be based on an audio signal with different gain values applied to different frequencies. As an example and not by way of limitation, lower acoustic frequencies may experience greater loss than higher frequencies when propagating through a person's body 160, and to compensate for this greater loss, an acoustic signal may be generated from an audio signal by boosting the gain of lower-frequency components relative to higher-frequency components. Although this disclosure describes particular acoustic signals having particular frequency, amplitude, or phase characteristics or having particular signal-modulation schemes, this disclosure contemplates any suitable acoustic signals having any suitable frequency, amplitude, or phase characteristics or having any suitable signal-modulation schemes.

In particular embodiments, transducer assembly 100 may include acoustic couplant 120. Acoustic couplant 120 may facilitate the transmission or coupling of an acoustic signal from transducer 110 to a person's skin layer 150 and into body 160 of the person. In particular embodiments, the acoustic impedance of transducer 110 may not be well matched to the acoustic impedance of air, and so transducer 110 may not efficiently couple an acoustic signal into air. In particular embodiments, the acoustic impedance of transducer 110 may be well matched to the acoustic impedance of a person's skin layer 150 or body 160. If a surface of transducer 110 makes good mechanical contact with a person's skin layer 150, then transducer 110 may be able to efficiently couple an acoustic signal into a person's body 160. However, small air pockets or other material disposed between transducer 110 and skin layer 150 may lead to an impedance mismatch that prevents efficient coupling of an acoustic signal directly from transducer 110 to skin 150 or body 160. Moreover, rather than being coupled from transducer 110 to skin 150 or body 160, a significant portion of an acoustic signal may be reflected away from a transducer-air interface due to an impedance mismatch between transducer 110 and one or more air pockets. In particular embodiments, a first material such as, for example, acoustic couplant 120 may provide an acoustic impedance match between transducer 110 and skin 150 or body 160 so that an acoustic signal is coupled from transducer 110 to skin 150 or body 160 with relatively high efficiency and with relatively low reflection losses. In addition or the alternative, acoustic couplant 120 may provide good mechanical coupling between transducer 110 and skin layer 150, and acoustic couplant 120 may substantially reduce or remove air cavities between transducer 110 and skin layer 150. In particular embodiments, acoustic couplant 120 may include a material that has an acoustic impedance that matches or is similar to the acoustic impedances of transducer 110 and skin layer 150 or body 160. Although this disclosure describes and illustrates particular acoustic couplants having particular acoustic impedance properties, this disclosure contemplates any suitable acoustic couplants having any suitable acoustic impedance properties.

In particular embodiments, acoustic couplant 120 may include a liquid, gel, or paste material that is mechanically flexible or deformable. As examples and not by way of limitation, acoustic couplant 120 may include silicone, glycerin, water, oil, grease, or propylene glycol. In particular embodiments, acoustic couplant 120 may include a liquid, gel, or paste material contained in a flexible enclosure. As an example and not by way of limitation, acoustic couplant 120 may include an amount of silicone contained within a flexible plastic enclosure (e.g., a sealed enclosure made of vinyl or polyethylene). As another example and not by way of limitation, acoustic couplant 120 may include an amount of silicone in gel form that is contained within a layer of silicone that has been cured or hardened to form a flexible, substantially non-porous outer layer that contains the gel-like silicone within. In particular embodiments, acoustic couplant 120 may include a flexible or compliant solid material (e.g., a material having low stiffness or rigidity) that conforms to contours of a person's body 160 and efficiently couples an acoustic signal from transducer 110 into the person's body 160. As examples and not by way of limitation, acoustic couplant 120 may include a sheet or layer of flexible material, such as for example, a sheet or layer of vinyl, rubber, or foam. In particular embodiments, acoustic couplant 120 may include a solid structure that is less rigid than the body of transducer 110 so that an acoustic vibration is efficiently coupled through couplant 120. As an example and not by way of limitation, acoustic couplant 120 may be a metallic or plastic structure that is flexible or spring-like and allows couplant 120 to conform to skin layer 150 and efficiently couple an acoustic signal to skin layer 150 or body 160. Although this disclosure describes and illustrates particular acoustic couplants that include particular materials, this disclosure contemplates any suitable acoustic couplants that include any suitable materials.

In particular embodiments, acoustic couplant 120 may be a separate object that is attached to transducer 110. As an example and not by way of limitation, acoustic couplant 120 may include a gel-like material contained within a vinyl enclosure, and a portion of the vinyl enclosure may be attached (e.g., with adhesive or epoxy) to a bottom surface of transducer 110. As illustrated in the example of FIG. 1A, acoustic couplant 120 may include a layer of material disposed between a surface of transducer 110 and skin layer 150. As an example and not by way of limitation, acoustic couplant 120 may be attached to a bottom surface of transducer 110 and may be configured to conform to skin layer 150 when transducer assembly 100 is in contact with a person's body. In particular embodiments, acoustic couplant 120 may be integrated into or combined with transducer 110. As an example and not by way of limitation, a surface or a portion of the housing of transducer 110 may be made from a material that functions as an acoustic couplant 120. For example, the portion of transducer 110 configured to vibrate and produce an acoustic signal may include a rubbery or flexible material that provides good mechanical contact with skin layer 150 and a good acoustic impedance match to skin layer 150 or body 160.

In particular embodiments, acoustic couplant 120 may include an object or material that surrounds or contains transducer 110. As illustrated in the example of FIG. 1B, acoustic couplant 120 may include a gel-like material that surrounds transducer 110, and the gel-like material and transducer 110 may be contained together within an enclosure. As an example and not by way of limitation, transducer 110 may be immersed in silicone, and both the silicone and transducer 110 may be contained within a vinyl enclosure. As another example and not by way of limitation, transducer 110 may be immersed in silicone, and the silicone and transducer 110 may be contained within a layer of silicone that has been cured or hardened to form a flexible, substantially non-porous outer layer. In particular embodiments, enclosing transducer 110 within acoustic couplant 120 may direct acoustic waves emitted from one or more surfaces of transducer 110 to an area of contact between acoustic couplant 120 and skin 150 where there is a good impedance match. Although this disclosure describes and illustrates particular acoustic couplants disposed in particular manners with respect to particular transducers, this disclosure contemplates any suitable acoustic couplants disposed in any suitable manner with respect to any suitable transducers. For example, two or more of the example acoustic couplants described herein may be layered or otherwise combined or coupled to transmit an acoustic signal from a transducer to layer of skin.

In particular embodiments, transducer assembly 100 may include a second material such as, for example, impedance-mismatch element 130. In particular embodiments, impedance-mismatch element 130 may include a material having a different acoustic impedance than that of transducer 110 or of an environment of transducer 110. For example, impedance-mismatch element 130 may provide an impedance mismatch that reflects or absorbs a portion of an acoustic signal produced by transducer 110. An impedance-mismatch element 130 may substantially reduce the amount of acoustic signal that is emitted into the surrounding environment, such as for example air, around transducer 110. In particular embodiments, impedance-mismatch element 130 may be applied or attached to any surface not configured to conduct an acoustic signal to skin 150 or body 160. In particular embodiments, impedance-mismatch element 130 may include a separate object that is attached to transducer 110. In the example of FIG. 1A, impedance-mismatch element 130 includes a layer of material attached to a top surface of transducer 110 and a portion of the sides of transducer 110. In particular embodiments, transducer assembly 100 may not include a separate or discrete impedance-mismatch element 130. In particular embodiments, impedance-mismatch element 130 may be integrated into or combined with transducer 110. As an example and not by way of limitation, a portion of the housing or outer surface of transducer 110 may be made of a material (e.g., aluminum or a hard plastic material) that has an impedance mismatch relative to air. An aluminum housing of transducer 110 may have a poor impedance match with air, providing for a relatively small amount of coupling of an acoustic signal from transducer into the surrounding air. In particular embodiments, transducer assembly 100 may not include an impedance-mismatch element 130. In the example of FIG. 1B, transducer assembly 100 does not include an impedance-mismatch element 130. In FIG. 1B, transducer 110 is surrounded by acoustic couplant 120 which provides an impedance-matching coupling between surfaces of transducer 110 and skin layer 150. In FIG. 1B, rather than being reflected or emitted into the surrounding air, an acoustic signal emitted by a surface of transducer 110 may propagate through acoustic couplant 120 and then be coupled to skin layer 150. Although this disclosure describes and illustrates particular transducer assemblies that include particular impedance-mismatch elements, this disclosure contemplates any suitable transducer assemblies that include any suitable impedance-mismatch elements.

In particular embodiments, transducer assembly 100 may include isolation element 140. As illustrated in FIGS. 1A and 1B, isolation element 140 may enclose or cover other elements of transducer assembly 100 and may form an outer layer of transducer assembly 100. In particular embodiments, isolation element 140 may also be at least part of impedance-mismatch element 130. In particular embodiments, isolation element 140 may absorb, attenuate, or reflect a significant portion of an acoustic signal emitted by transducer 110 into the surrounding environment of transducer assembly 110, such as for example air. In particular embodiments, isolation element 140 may substantially reduce leakage of an acoustic signal from transducer 110 into the environment surrounding transducer assembly 100. As an example and not by way of limitation, isolation element 140 may reduce leakage of an acoustic signal into the surrounding environment so that a person wearing an audio device with transducer assembly 100 may be able to hear an audio signal from transducer assembly 100 without that signal being overheard by other people located nearby. In particular embodiments, isolation element 140 may provide a mismatch of acoustic impedance between the interior of transducer assembly 100 and the environment surrounding transducer assembly 100. In particular embodiments, isolation element 140 may include any suitable material that substantially absorbs, attenuates, or reflects an acoustic signal emitted by transducer 110. As examples and not by way of limitation, isolation element 140 may include one or more of the following materials: cotton, plastic, cork, rubber, vinyl, polyurethane foam, soundproof foam, cardboard, a gel material, or any suitable combination thereof. Although this disclosure describes and illustrates particular transducer assemblies that include particular isolation elements, this disclosure contemplates any suitable transducer assemblies that include any suitable isolation elements.

In particular embodiments, transducer assembly 100 may include both an impedance-mismatch element 130 and an isolation element 140. As illustrated in FIG. 1A, transducer assembly 100 includes impedance-mismatch element 130 and isolation element 140. In particular embodiments, transducer assembly 100 may include impedance-mismatch element 130 and not include isolation element 140. In particular embodiments and as illustrated in FIG. 1B, transducer assembly 100 may include acoustic couplant 120 and isolation element 140 and may not include impedance-mismatch element 130. In particular embodiments, transducer assembly 100 may include isolation element 140, and although a discrete impedance-mismatch element 130 may not be present, a portion of transducer 110 may include a material that performs as an impedance-mismatch element by preventing a significant amount of an acoustic signal from being coupled to the surrounding environment. In particular embodiments, transducer assembly 100 may include a single object that performs as both an impedance-mismatch element 130 and an isolation element 140. In particular embodiments impedance-mismatch element 130 or isolation element 140 may enable a user to hear an audio signal from transducer assembly 100 without that sound being overheard by other people nearby, or with that sound being heard at a reduced volume by other people nearby. As an example and not by way of limitation, impedance-mismatch element 130 or isolation element 140 may reflect or absorb an acoustic signal preventing most of that signal from propagating into the air surrounding transducer assembly 100. Although this disclosure describes and illustrates particular transducer assemblies that include particular combinations of acoustic couplants, impedance-mismatch elements, or isolation elements, this disclosure contemplates any suitable transducer assemblies that include any suitable combination of acoustic couplants, impedance-mismatch elements, or isolation elements.

Figure 2:
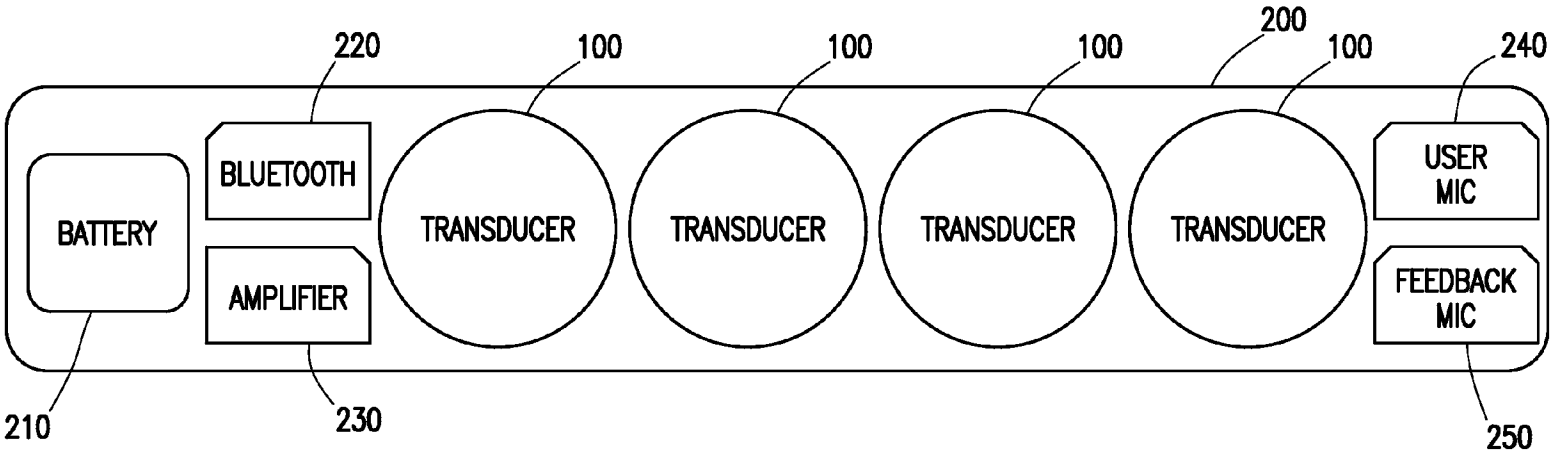
FIG. 2 illustrates an example wearable audio device that includes example transducer assemblies.

FIG. 2 illustrates an example wearable audio device 200 that includes example transducer assemblies 100. In particular embodiments, wearable audio device 200 may be configured to be worn on or around, attached to, or in contact with a part of a person's body. In particular embodiments, wearable audio device 200 may include 1, 2, 3, 4, 6, 10, or any suitable number of transducer assemblies 100. As an example and not by way of limitation, wearable audio device 200 may be configured to be worn around a user's wrist, and wearable audio device 200 may include a single transducer assembly used to send acoustic signals that are heard as notifications (e.g., beeps, clicks, or tones) by the user. In the example of FIG. 2, wearable audio device 200 includes four transducer assemblies 100, and wearable audio device 200 may be configured to be worn near or around a person's neck or shoulder area. In particular embodiments, wearable audio device 200 may include a single transducer assembly 100 configured to produce an acoustic signal over a particular audible frequency range (e.g., 10 Hz-3 kHz or 20 Hz-20 kHz), a particular ultrasonic frequency range (e.g., 30 kHz-50 kHz or 20 kHz-100 kHz), or over a particular broad frequency range that includes audible and ultrasonic frequencies (e.g., 20 Hz-100 kHz or 10 kHz-50 kHz). In particular embodiments, wearable audio device 200 may include two or more transducer assemblies 100, each assembly configured to produce an acoustic signal over a particular frequency range. As an example and not by way of limitation, wearable audio device 200 may include two transducer assemblies 100, one transducer assembly 100 for operation in an audible frequency range (e.g., 20 Hz-20 kHz) and another transducer assembly 100 for operation in an ultrasonic frequency range (e.g., 20 kHz-100 kHz). As another example and not by way of limitation, wearable audio device 200 may include three transducer assemblies 100 that together cover a particular audible or ultrasonic frequency range (e.g., the three transducer assemblies 100 may operate at 20 Hz-3 kHz, 3 kHz-8 kHz, and 8 kHz-16 kHz, respectively, so that together they cover a frequency range from 20 Hz to 16 kHz). As another example and not by way of limitation, wearable audio device 200 may be configured to provide a two-channel (or, stereophonic) audio signal, and wearable audio device 200 may include two transducer assemblies 100 that provide a left-channel signal to a person's left ear and another two transducer assemblies 100 that provide a right-channel signal to a person's right ear. Although this disclosure describes and illustrates particular wearable audio devices that include particular transducer assemblies configured to produce particular acoustic signals over particular frequency ranges, this disclosure contemplates any suitable wearable audio devices that include any suitable transducer assemblies configured to produce any suitable acoustic signals over any suitable frequency ranges.

In particular embodiments, wearable audio device 200 may include a power source (e.g., battery 210) or a connection to an external power source. In the example of FIG. 2, wearable audio device 200 includes battery 210 for supplying electrical power to electronic devices included in wearable audio device 200. In particular embodiments, battery 210 may be a rechargeable battery. In particular embodiments, wearable audio device 200 may include wireless device 220 for sending or receiving information using a wireless communication protocol (e.g., BLUETOOTH, WI-FI, or cellular). In the example of FIG. 2, wireless device 220 is a BLUETOOTH device 220 for sending or receiving wireless signals using a BLUETOOTH communication protocol. As an example and not by way of limitation, BLUETOOTH device 220 may receive a music signal from a user's smartphone, and transducer assemblies 100 of wearable audio device 200 may produce an acoustic signal based on the received music signal. In particular embodiments, wearable audio device 200 may include one or more electronic amplifiers 230. As an example and not by way of limitation, wearable audio device 200 may include one or more electronic amplifiers 230 for amplifying and supplying a drive signal to one or more transducer assemblies 100. In particular embodiments, each transducer assembly 100 may be associated with an electronic amplifier 230 that supplies a drive signal. In particular embodiments, wearable audio device 200 may include a processor. As an example and not by way of limitation, a processor may receive a digital signal from BLUETOOTH device 220 and generate a low-amplitude, analog drive signal, which is sent to amplifier 230 for amplification. In particular embodiments, wearable audio device 200 may include user microphone 240 for receiving audio input from a user wearing the device. As an example and not by way of limitation, user microphone 240 may be used to receive voice commands from a user. As another example and not by way of limitation, wearable audio device 200 may function as a wireless communication device (e.g., a cellular phone), and user microphone 240 may receive a user's voice as part of a phone conversation. In particular embodiments, user microphone 240 may be used to sample sounds or noise from the surrounding environment for active noise cancelling. In particular embodiments, wearable audio device 200 may include a device for determining a user's location, such as for example a device that uses the Global Positioning System (GPS) to determine location. As an example and not by way of limitation, wearable audio device 200 with a GPS capability may be used to provide driving directions to a user.

In particular embodiments, wearable audio device 200 may include one or more feedback microphones 250 for receiving a reflected acoustic signal to determine one or more acoustic properties of a pathway taken by an acoustic signal between wearable audio device 200 and a user's ear. For example, feedback microphone 250 may receive a reflected acoustic signal to determine one or more acoustic properties of a user's body. As an example and not by way of limitation, transducer assembly 100 may send an acoustic test signal into a user's body, and feedback microphone 250 may receive a portion of the test signal as a reflection (or, echo). The acoustic test signal may include a particular acoustic frequency, a combination or range of frequencies, or an acoustic pulse (e.g., an acoustic pulse with a 5 μs duration). The reflected acoustic signal may be reflected off one or more portions of a pathway, such as a user's body (e.g., muscle, tissue, bone, or a skin layer on a side opposite from the transducer assembly), and a processor of wearable audio device 200 may determine an acoustic property of the user's body based on one or more characteristics of the reflected signal (e.g., amplitude, phase, or frequency characteristics, or a time-of-flight between transmission of the acoustic test signal and receipt of the reflected signal). As an example and not by way of limitation, the reflected acoustic signal received by feedback microphone 250 may be used to determine where audio device 200 is located on a person's body (e.g., on a person's wrist or about their neck) or to determine a composition or thickness of nearby tissues (e.g., a thickness of skin layer 150, muscle, or fat).

In particular embodiments, wearable audio device 200 may automatically adjust one or more characteristics of an acoustic signal based on acoustic properties determined from a reflected acoustic signal received by feedback microphone 250. As an example and not by way of limitation, if wearable audio device 200 is determined to be relatively far from the user's ears (e.g., wearable audio device 200 is attached to the user's wrist), wearable audio device 200 may send an acoustic signal at an ultrasonic frequency range so the acoustic signal may be efficiently transmitted to the user's ears. As another example and not by way of limitation, if wearable audio device 200 is determined to be relatively close to the user's ears, wearable audio device 200 may send an acoustic signal at an audible frequency range. As another example and not by way of limitation, the frequency of a carrier signal may be adjusted based on a reflected acoustic signal. As another example and not by way of limitation, wearable audio device 200 may, based on a reflected acoustic signal, adjust the frequency of an ultrasonic acoustic signal within an ultrasonic frequency range, for example to more efficiently transmit the acoustic signal to a wearer's ear. Likewise, wearable audio device 200 may, based on a reflected acoustic signal, adjust the frequency of an audible acoustic signal within an audible frequency range. Additionally or in the alternative, audio device 200 may adjust the amplitude of an acoustic signal based on a determination of where audio device 200 is located (e.g., acoustic-signal amplitude may be increased for locations farther from a user's ears). In particular embodiments, wearable audio device 200 may include feedback microphone 250 that is separate from one or more transducer assemblies 100 of wearable audio device 200. As an example and not by way of limitation, wearable audio device 200 may include one feedback microphone 250 and four transducer assemblies 100. In particular embodiments, one or more transducer assemblies 100 may be configured to function as feedback microphone 250. As an example and not by way of limitation, one or more transducer assemblies 100 of wearable audio device 200 may send an acoustic test signal into a person's body, and one or more transducer assemblies 100 of wearable audio device 200 may be configured to receive a portion of the reflected test signal and generate an electrical signal based on the received mechanical vibration. The one or more transducer assemblies 100 used to send and receive the signals may be the same transducer assemblies 100 or different transducer assemblies 100. Although this disclosure describes determining particular acoustic properties in particular manners, this disclosure contemplates determining any suitable acoustic properties in any suitable manner.

In particular embodiments, wearable audio device 200 may include an equalizer to adjust the relative amplitudes of different frequency components of an acoustic signal. As an example and not by way of limitation, frequencies that are attenuated more than others during propagation to a user's ears may be boosted by an equalizer to balance the sound heard by the user. In particular embodiments, wearable audio device 200 may automatically adjust an equalizer's settings based on acoustic properties of a user's body determined from a reflected acoustic test signal received by feedback microphone 250. In particular embodiments, a user may manually adjust the settings of an equalizer to modify the sound. As an example and not by way of limitation, while listening to music, a user may adjust the relative amplitudes of the bass or treble frequencies to match their preference. Additionally, a user may manually adjust the overall amplitude of an acoustic signal to change the volume of sound that is heard. In particular embodiments, wearable audio device 200 may include two or more transducer assemblies 100, and each transducer assembly 100 may be configured to operate over a particular frequency range. As an example and not by way of limitation, wearable audio device 200 may apply equalization to an acoustic signal by adjusting the relative amplitude of the drive signals for each of its transducer assemblies 100. In particular embodiments, wearable audio device 200 may include a discrete device that functions as an equalizer, or an equalizer function may be included within a processor of wearable audio device 200. Although this disclosure describes particular wearable audio devices that perform equalization in particular manners, this disclosure contemplates any suitable wearable audio devices that perform equalization in any suitable manner.

In particular embodiments, in addition to transducer assemblies 100, wearable audio device 200 may include any other suitable devices, including some, none, or all of the devices described herein. As an example and not by way of limitation, wearable audio device 200 may only include one or more transducer assemblies attached to or contained within a band or enclosure that may be worn by or attached to a portion of a user's body, and wearable audio device 200 may be connected by a cable to another device that includes one or more of the following: a power source, a processor, a communication device (e.g., BLUETOOTH device 220), an amplifier 230, a user microphone 240, a GPS-based device, or any other suitable device. As another example and not by way of limitation, in addition to one or more transducer assemblies 100, wearable audio device 200 may include battery 210, a processor, BLUETOOTH device 220, and amplifier 230. As another example and not by way of limitation, in addition to one or more transducer assemblies 100, wearable audio device 200 may include battery 210, a processor, BLUETOOTH device 200, amplifier 230, user microphone 240, and feedback microphone 250. Although this disclosure describes and illustrates particular wearable audio devices that include particular devices having particular functions, this disclosure contemplates any suitable wearable audio devices that include any suitable devices having any suitable functions.

In particular embodiments, an acoustic signal from transducer assembly 100 may be coupled to a person's body and may propagate through their body to one or both of the person's ears. An acoustic signal may propagate through any suitable part or combination of parts of a person's body, including but not limited to soft tissue (e.g., fat, muscle, skin, tendons, ligaments, fascia, connective tissue, nerves, or blood cells), organs, or bone. As an example and not by way of limitation, an acoustic signal from transducer assembly 100 coupled to a person's shoulder or neck area may be conducted to the person's ears by a combination of skin, muscle, fat, or bone. In particular embodiments, transducer assembly 100 may be configured to couple an acoustic signal to soft tissue (e.g., skin, fat, muscle, or any other suitable soft tissue) of a person's body and may not be configured to couple an acoustic signal to bone. As an example and not by way of limitation, transducer assembly 100 may couple an acoustic signal to skin, muscle, and fat located near transducer assembly 100, and once coupled to a person's body, the acoustic signal may propagate through the person's body through any suitable combination of soft tissue, organs, or bone. In particular embodiments, different frequencies of an acoustic signal may have different propagation characteristics when traveling through a person's body. As an example and not by way of limitation, lower-frequency acoustic waves may penetrate deeper into a person's body, while higher-frequency acoustic waves may have a lower depth of penetration and may propagate through the body primarily by skin layer 150 or by tissues or bones located closer to the skin surface. As another example and not by way of limitation, higher frequencies may experience less attenuation than lower frequencies when propagating through a person's body. In particular embodiments, an audible signal (e.g., a 20 Hz-3 kHz signal) may be mixed with a higher-frequency carrier signal (e.g., a 40-kHz carrier signal) to form a modulated higher-frequency acoustic signal that may have lower propagation losses when traveling through a person's body than a lower-frequency acoustic signal. Although this disclosure describes particular acoustic signals propagating through a person's body in particular manners, this disclosure contemplates any suitable acoustic signals propagating through a person's body in any suitable manner.

In particular embodiments, after propagating through a person's body to their ear, an acoustic signal may interact with a portion of the person's ear (e.g., outer ear, middle ear, inner ear) to result in a sound being heard by the person. As an example and not by way of limitation, an acoustic signal may vibrate a portion of a person's ear, such as for example, the tympanic membrane, an auditory ossicle, the oval window, fluid of the inner ear, or any suitable portion or combination of portions of a person's ear. In particular embodiments, an acoustic signal in an audible frequency range (e.g., 20 Hz-20 kHz) may directly vibrate a portion of a person's ear resulting in the person hearing a sound corresponding to the audible acoustic signal. As an example and not by way of limitation, a low-frequency acoustic signal (e.g., 100 Hz) may result in a person hearing a low tone (e.g., a 100-Hz tone), while a high-frequency acoustic signal (e.g., 8 kHz) may result in the person hearing a high tone (e.g., a 8-kHz tone). In particular embodiments, an acoustic signal in an ultrasonic frequency range may vibrate a portion of a person's ear resulting in the person hearing a sound corresponding to an audible frequency. As an example and not by way of limitation, an acoustic signal that includes an ultrasonic carrier frequency (e.g., 30 kHz) with an amplitude modulation in an audible frequency range may be substantially low-pass filtered by a portion of a person's ear resulting in the person hearing a sound corresponding to the envelope audible-frequency portion of the acoustic signal. As another example and not by way of limitation, an acoustic signal that includes an ultrasonic carrier frequency with a modulation in an audible frequency range may be converted by a portion of a person's ear into an audible signal corresponding to the modulated audible portion. In particular embodiments, two or more acoustic signals in an ultrasonic frequency range may combine at a person's ear to produce an audible signal that the person may hear. As an example and not by way of limitation, two or more different signals may be applied to two or more respective transducer assemblies 100, and the resulting acoustic signals may add constructively at a person's ear and produce an audible signal that the person may hear. The two or more signals may both be in the ultrasonic frequency range, and they may differ in terms of their frequencies or relative phases. Although this disclosure describes particular acoustic signals that produce sound in a person's ear in particular manners, this disclosure contemplates any suitable acoustic signals that produce sound in a person's ear in any suitable manner.

Figure 3:
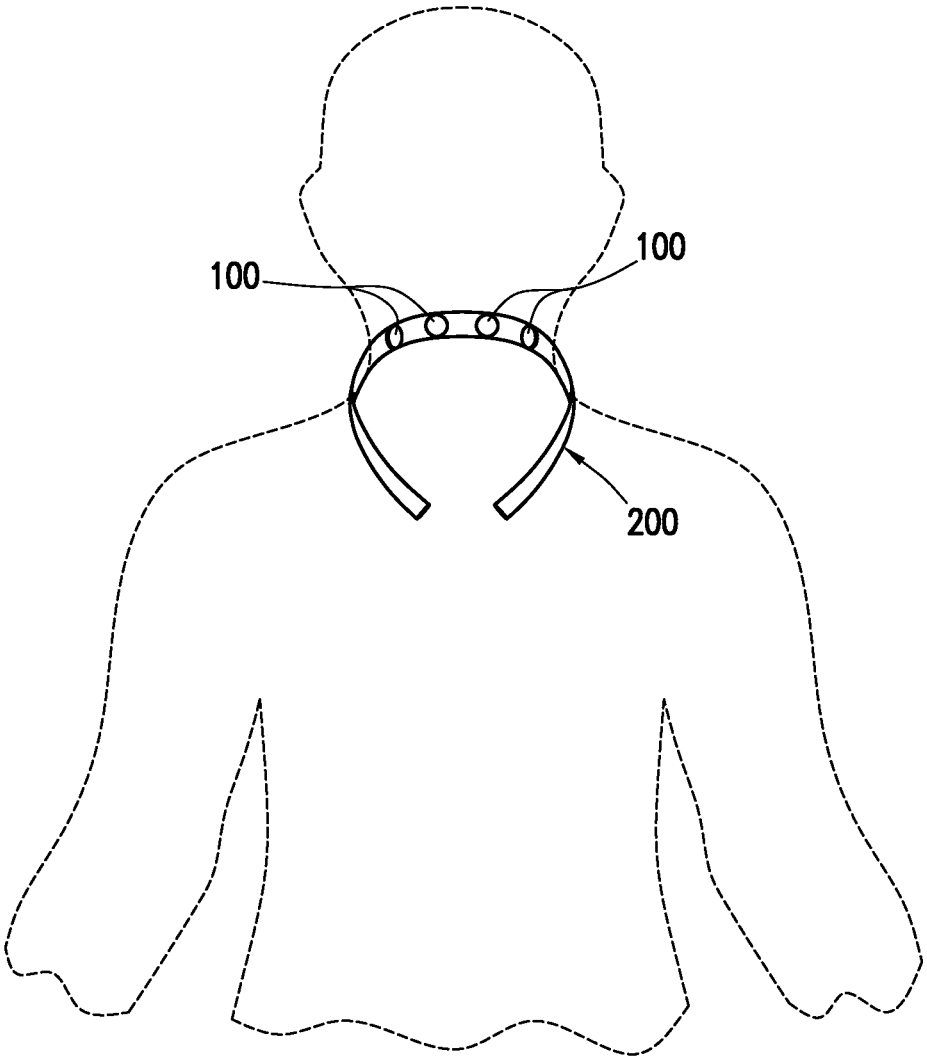
FIG. 3 illustrates an example wearable audio device worn about a person's neck.

FIG. 3 illustrates an example wearable audio device 200 worn about a person's neck. In particular embodiments, wearable audio device 200 may include one or more transducer assemblies 100 configured to send one or more acoustic signals through a person's body resulting in sounds that may be heard by the wearer of audio device 200. In particular embodiments, transducer assemblies 100 may allow wearable audio device 200 to be used for media playback or phone conversations. In the example of FIG. 3, wearable audio device 200 may include two or more transducer assemblies 100 configured for transmission of stereophonic sound to the wearer's ears. One or more transducer assemblies 100 may be configured to provide sound primarily to the wearer's left ear, and one or more other transducer assemblies 100 may be configured to provide sound primarily to the wearer's right ear. In particular embodiments, wearable audio device 200 may include one or more weights (such as, for example, in a counterbalanced neckband) to ensure good physical contact between transducer assemblies 100 and a wearer's skin 150. In the example of FIG. 3, the two ends of wearable audio device 200 that extend down may each contain a small weight or an electronic component of audio device (e.g., a battery) that adds weight to the end. In particular embodiments, wearable audio device 200 may include a flexible or tensioned band configured to provide mechanical contact between transducer assemblies 100 and a wearer's skin 150. As an example and not by way of limitation, wearable audio device 200 may include a flexible band that can be wrapped around a person's wrist or arm and provide tension so that transducer assemblies 100 have good mechanical contact with a wearer's skin 150.

Figure 4:
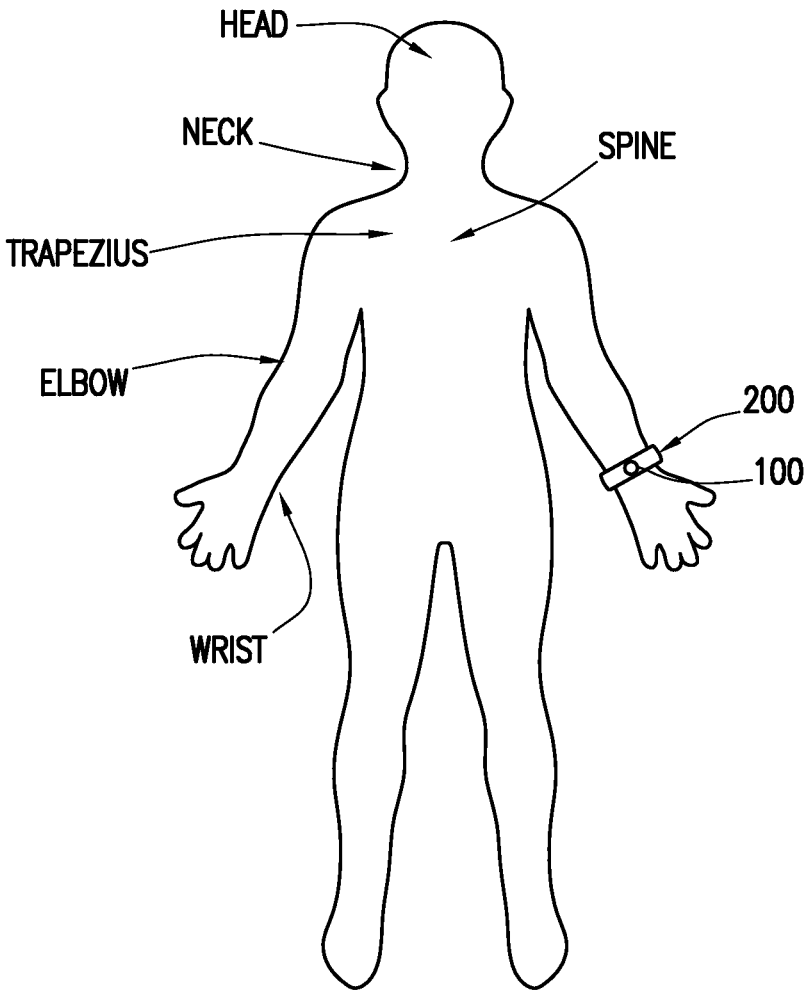
FIG. 4 illustrates example contact locations for a wearable audio device.

FIG. 4 illustrates example contact locations for wearable audio device 200. In particular embodiments, wearable audio device 200 may be worn around or near a person's wrist, elbow, trapezius, spine, neck, head, or forehead. As illustrated in FIG. 4, wearable audio device 200 may be worn around a person's wrist (e.g., in a watch, bracelet, or wrist band) and may include transducer assembly 100 to transmit audio notifications (e.g., a beep, click, or tone) to the wearer's ears. As another example and not by way of limitation, wearable audio device 200 may include a tensioned headband that is worn around a person's forehead. As another example and not by way of limitation, wearable audio device 200 may be worn about a person's neck or shoulder area and may couple an acoustic signal to skin, muscle, fat, or other soft tissue near the person's neck, spine, or trapezius. Although this disclosure describes and illustrates particular audio devices having particular contact locations with a user's body, this disclosure contemplates any suitable audio devices having any suitable contact locations with a user's body.

In particular embodiments, wearable audio device 200 may utilize body-transmitted acoustics in an audible or ultrasonic range allowing sound to be heard by a user without having their ears covered or occluded. As an example and not by way of limitation, a user may be able to listen to audio from wearable audio device 200 while still being able to hear sound from their surroundings. In particular embodiments, wearable audio device 200 may be used for environmental-noise cancellation where microphone 240 samples surrounding acoustic noise, and one or more transducer assemblies 100 send a noise-cancelling acoustic signal to a user's ears to reduce environmental noise heard by the user. In particular embodiments, wearable audio device 200 may be used to send any suitable acoustic signal to a user's ears, such as for example, a noise-cancelling signal, a background sound or noise (e.g., acoustic white noise), an alert, a notification, navigation information (e.g., driving directions), a phone conversation, media playback (e.g., music or sound from a video), or any suitable combination thereof. In particular embodiments, wearable audio device 200 may send audio signals to a user without that signal being overheard by other people nearby. As an example and not by way of limitation, wearable audio device 200 may allow for private notifications (e.g., a beep, click, or tone that indicates the user received a message, email, or phone call) that may only heard by the wearer. In particular embodiments, wearable audio device 200 may be incorporated into a neck pillow. As an example and not by way of limitation, a neck pillow with wearable audio device 200 may be used for noise cancellation during airplane travel. In particular embodiments, wearable audio device 200 may be incorporated into clothing. As an example and not by way of limitation, wearable audio device 200 may be incorporated into a collar of a shirt or sweater. In particular embodiments, wearable audio device 200 may be incorporated into a helmet or a head or neck support of a car seat and may provide an audio signal through contact with a portion of a person's head or neck. As an example and not by way of limitation, a wearable audio device 200 incorporated into a car seat neck support may be used to provide driving directions. Although this disclosure describes and illustrates particular wearable audio devices configured to provide particular acoustic signals to a user, this disclosure contemplates any suitable wearable audio devices configured to provide any suitable acoustic signals to a user.

In particular embodiments, wearable audio device 200 may be used to determine a person's posture or body position. As an example and not by way of limitation, wearable audio device 200 may be used to determine whether a person's posture is straight or slouched or whether a person is standing, sitting, or lying down based on one or more acoustic properties of a person's body. In particular embodiments, and as described more fully herein, wearable audio device 200 may send an acoustic test signal into a user's body, and feedback microphone 250 may receive a portion of the reflected test signal. Based on one or more characteristics of the received reflected signal (e.g., amplitude, phase, frequency, or time-of-flight), wearable audio device 200 may determine a person's posture or body position. As an example and not by way of limitation, wearable audio device 200 may be worn about a person's neck or shoulder area, and one or more characteristics of a received reflected signal may change depending on whether a person is standing, sitting, or lying down. In particular embodiments, wearable audio device 200 may provide a message or notification to a user (or may refrain from providing a message or notification to the user) based on their determined posture or body position. As an example and not by way of limitation, if wearable audio device 200 determines that a user has poor or slouched posture, wearable audio device 200 may send an audio notification or message to the user reminding them to maintain a better posture. As another example and not by way of limitation, if wearable audio device 200 determines that a user is lying down, then wearable audio device 200 may refrain from sending a message or notification to the user since they may be resting or sleeping and not wish to be disturbed. Although this disclosure describes and illustrates particular wearable audio devices 200 configured to determine particular body positions of a person, this disclosure contemplates any suitable wearable audio devices configured to determine any suitable body positions of a person.

Figure 5:
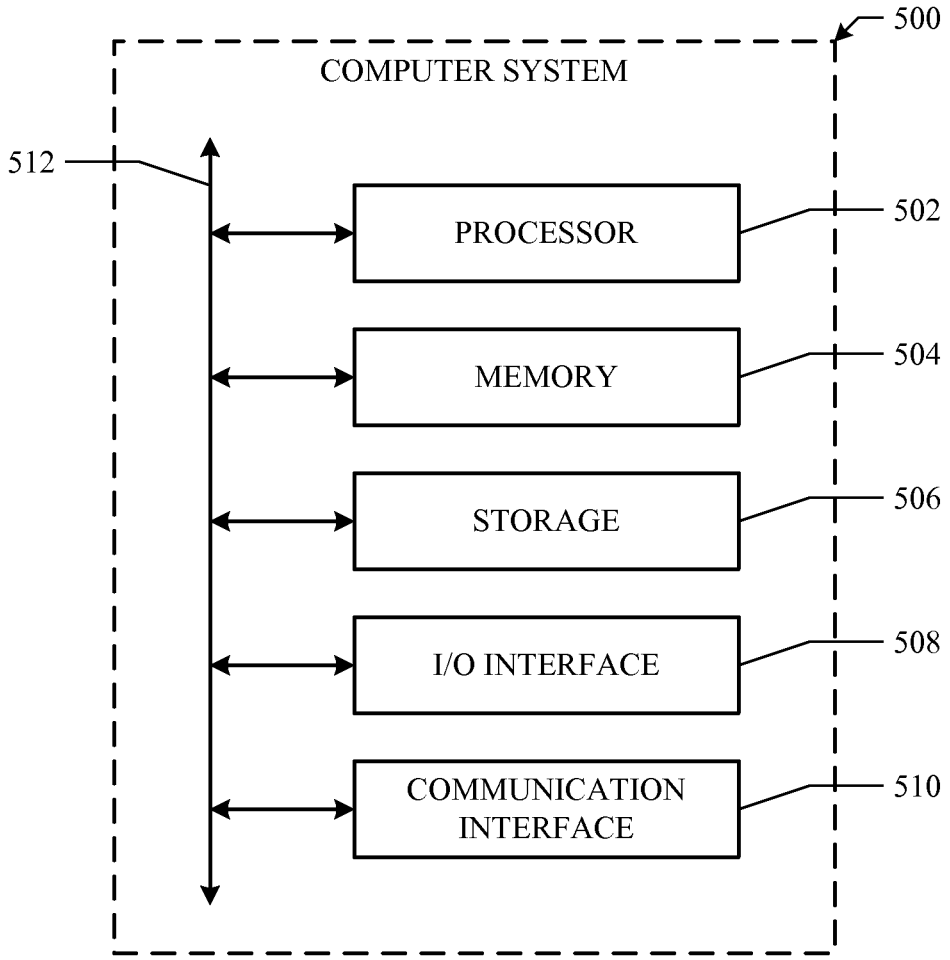
FIG. 5 illustrates an example computer system.

FIG. 5 illustrates an example computer system 500. In particular embodiments, one or more computer systems 500 perform one or more steps of one or more methods described or illustrated herein. In particular embodiments, one or more computer systems 500 provide functionality described or illustrated herein. In particular embodiments, software running on one or more computer systems 500 performs one or more steps of one or more methods described or illustrated herein or provides functionality described or illustrated herein. Particular embodiments include one or more portions of one or more computer systems 500. Herein, reference to a computer system may encompass a computing device, and vice versa, where appropriate. Moreover, reference to a computer system may encompass one or more computer systems, where appropriate.

This disclosure contemplates any suitable number of computer systems 500. This disclosure contemplates computer system 500 taking any suitable physical form. As example and not by way of limitation, computer system 500 may be an embedded computer system, a system-on-chip (SOC), a single-board computer system (SBC) (such as, for example, a computer-on-module (COM) or system-on-module (SOM)), a desktop computer system, a laptop or notebook computer system, an interactive kiosk, a mainframe, a mesh of computer systems, a mobile telephone, a personal digital assistant (PDA), a server, a tablet computer system, or a combination of two or more of these. Where appropriate, computer system 500 may include one or more computer systems 500; be unitary or distributed; span multiple locations; span multiple machines; span multiple data centers; or reside in a cloud, which may include one or more cloud components in one or more networks. Where appropriate, one or more computer systems 500 may perform without substantial spatial or temporal limitation one or more steps of one or more methods described or illustrated herein. As an example and not by way of limitation, one or more computer systems 500 may perform in real time or in batch mode one or more steps of one or more methods described or illustrated herein. One or more computer systems 500 may perform at different times or at different locations one or more steps of one or more methods described or illustrated herein, where appropriate.

In particular embodiments, computer system 500 includes a processor 502, memory 504, storage 506, an input/output (I/O) interface 508, a communication interface 510, and a bus 512. Although this disclosure describes and illustrates a particular computer system having a particular number of particular components in a particular arrangement, this disclosure contemplates any suitable computer system having any suitable number of any suitable components in any suitable arrangement.

In particular embodiments, processor 502 includes hardware for executing instructions, such as those making up a computer program. As an example and not by way of limitation, to execute instructions, processor 502 may retrieve (or fetch) the instructions from an internal register, an internal cache, memory 504, or storage 506; decode and execute them; and then write one or more results to an internal register, an internal cache, memory 504, or storage 506. In particular embodiments, processor 502 may include one or more internal caches for data, instructions, or addresses. This disclosure contemplates processor 502 including any suitable number of any suitable internal caches, where appropriate. As an example and not by way of limitation, processor 502 may include one or more instruction caches, one or more data caches, and one or more translation lookaside buffers (TLBs). Instructions in the instruction caches may be copies of instructions in memory 504 or storage 506, and the instruction caches may speed up retrieval of those instructions by processor 502. Data in the data caches may be copies of data in memory 504 or storage 506 for instructions executing at processor 502 to operate on; the results of previous instructions executed at processor 502 for access by subsequent instructions executing at processor 502 or for writing to memory 504 or storage 506; or other suitable data. The data caches may speed up read or write operations by processor 502. The TLBs may speed up virtual-address translation for processor 502. In particular embodiments, processor 502 may include one or more internal registers for data, instructions, or addresses. This disclosure contemplates processor 502 including any suitable number of any suitable internal registers, where appropriate. Where appropriate, processor 502 may include one or more arithmetic logic units (ALUs); be a multi-core processor; or include one or more processors 502. Although this disclosure describes and illustrates a particular processor, this disclosure contemplates any suitable processor.

In particular embodiments, memory 504 includes main memory for storing instructions for processor 502 to execute or data for processor 502 to operate on. As an example and not by way of limitation, computer system 500 may load instructions from storage 506 or another source (such as, for example, another computer system 500) to memory 504. Processor 502 may then load the instructions from memory 504 to an internal register or internal cache. To execute the instructions, processor 502 may retrieve the instructions from the internal register or internal cache and decode them. During or after execution of the instructions, processor 502 may write one or more results (which may be intermediate or final results) to the internal register or internal cache. Processor 502 may then write one or more of those results to memory 504. In particular embodiments, processor 502 executes only instructions in one or more internal registers or internal caches or in memory 504 (as opposed to storage 506 or elsewhere) and operates only on data in one or more internal registers or internal caches or in memory 504 (as opposed to storage 506 or elsewhere). One or more memory buses (which may each include an address bus and a data bus) may couple processor 502 to memory 504. Bus 512 may include one or more memory buses, as described below. In particular embodiments, one or more memory management units (MMUs) reside between processor 502 and memory 504 and facilitate accesses to memory 504 requested by processor 502. In particular embodiments, memory 504 includes random access memory (RAM). This RAM may be volatile memory, where appropriate, and this RAM may be dynamic RAM (DRAM) or static RAM (SRAM), where appropriate. Moreover, where appropriate, this RAM may be single-ported or multi-ported RAM. This disclosure contemplates any suitable RAM. Memory 504 may include one or more memories 504, where appropriate. Although this disclosure describes and illustrates particular memory, this disclosure contemplates any suitable memory.

In particular embodiments, storage 506 includes mass storage for data or instructions. As an example and not by way of limitation, storage 506 may include a hard disk drive (HDD), a floppy disk drive, flash memory, an optical disc, a magneto-optical disc, magnetic tape, or a Universal Serial Bus (USB) drive or a combination of two or more of these. Storage 506 may include removable or non-removable (or fixed) media, where appropriate. Storage 506 may be internal or external to computer system 500, where appropriate.

In particular embodiments, storage 506 is non-volatile, solid-state memory. In particular embodiments, storage 506 includes read-only memory (ROM). Where appropriate, this ROM may be mask-programmed ROM, programmable ROM (PROM), erasable PROM (EPROM), electrically erasable PROM (EEPROM), electrically alterable ROM (EAROM), or flash memory or a combination of two or more of these. This disclosure contemplates mass storage 506 taking any suitable physical form. Storage 506 may include one or more storage control units facilitating communication between processor 502 and storage 506, where appropriate. Where appropriate, storage 506 may include one or more storages 506. Although this disclosure describes and illustrates particular storage, this disclosure contemplates any suitable storage.

In particular embodiments, I/O interface 508 includes hardware, software, or both, providing one or more interfaces for communication between computer system 500 and one or more I/O devices. Computer system 500 may include one or more of these I/O devices, where appropriate. One or more of these I/O devices may enable communication between a person and computer system 500. As an example and not by way of limitation, an I/O device may include a keyboard, keypad, microphone, monitor, mouse, printer, scanner, speaker, still camera, stylus, tablet, touch screen, trackball, video camera, another suitable I/O device or a combination of two or more of these. An I/O device may include one or more sensors. This disclosure contemplates any suitable I/O devices and any suitable I/O interfaces 508 for them. Where appropriate, I/O interface 508 may include one or more device or software drivers enabling processor 502 to drive one or more of these I/O devices. I/O interface 508 may include one or more I/O interfaces 508, where appropriate. Although this disclosure describes and illustrates a particular I/O interface, this disclosure contemplates any suitable I/O interface.

In particular embodiments, communication interface 510 includes hardware, software, or both providing one or more interfaces for communication (such as, for example, packet-based communication) between computer system 500 and one or more other computer systems 500 or one or more networks. As an example and not by way of limitation, communication interface 510 may include a network interface controller (NIC) or network adapter for communicating with an Ethernet or other wire-based network or a wireless NIC (WNIC) or wireless adapter for communicating with a wireless network, such as a WI-FI network. This disclosure contemplates any suitable network and any suitable communication interface 510 for it. As an example and not by way of limitation, computer system 500 may communicate with an ad hoc network, a personal area network (PAN), a local area network (LAN), a wide area network (WAN), a metropolitan area network (MAN), body area network (BAN), or one or more portions of the Internet or a combination of two or more of these. One or more portions of one or more of these networks may be wired or wireless. As an example, computer system 500 may communicate with a wireless PAN (WPAN) (such as, for example, a BLUETOOTH WPAN), a WI-FI network, a WI-MAX network, a cellular telephone network (such as, for example, a Global System for Mobile Communications (GSM) network), or other suitable wireless network or a combination of two or more of these. Computer system 500 may include any suitable communication interface 510 for any of these networks, where appropriate. Communication interface 510 may include one or more communication interfaces 510, where appropriate. Although this disclosure describes and illustrates a particular communication interface, this disclosure contemplates any suitable communication interface.

In particular embodiments, bus 512 includes hardware, software, or both coupling components of computer system 500 to each other. As an example and not by way of limitation, bus 512 may include an Accelerated Graphics Port (AGP) or other graphics bus, an Enhanced Industry Standard Architecture (EISA) bus, a front-side bus (FSB), a HYPERTRANSPORT (HT) interconnect, an Industry Standard Architecture (ISA) bus, an INFINIBAND interconnect, a low-pin-count (LPC) bus, a memory bus, a Micro Channel Architecture (MCA) bus, a Peripheral Component Interconnect (PCI) bus, a PCI-Express (PCIe) bus, a serial advanced technology attachment (SATA) bus, a Video Electronics Standards Association local (VLB) bus, or another suitable bus or a combination of two or more of these. Bus 512 may include one or more buses 512, where appropriate. Although this disclosure describes and illustrates a particular bus, this disclosure contemplates any suitable bus or interconnect.

Herein, a computer-readable non-transitory storage medium or media may include one or more semiconductor-based or other integrated circuits (ICs) (such, as for example, field-programmable gate arrays (FPGAs) or application-specific ICs (ASICs)), hard disk drives (HDDs), hybrid hard drives (HHDs), optical discs, optical disc drives (ODDs), magneto-optical discs, magneto-optical drives, floppy diskettes, floppy disk drives (FDDs), magnetic tapes, solid-state drives (SSDs), RAM-drives, SECURE DIGITAL cards or drives, any other suitable computer-readable non-transitory storage media, or any suitable combination of two or more of these, where appropriate. A computer-readable non-transitory storage medium may be volatile, non-volatile, or a combination of volatile and non-volatile, where appropriate.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

This scope of this disclosure encompasses all changes, substitutions, variations, alterations, and modifications to the example embodiments herein that a person having ordinary skill in the art would comprehend. The scope of this disclosure is not limited to the example embodiments described or illustrated herein. Moreover, although this disclosure describes or illustrates respective embodiments herein as including particular components, elements, functions, operations, or steps, any of these embodiments may include any combination or permutation of any of the components, elements, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative.

What is claimed is:

1. A device comprising:

a first transducer configured to vibrate within a first frequency range to generate a signal audible by a wearer of the device;

a first material on or near a first surface of the first transducer, the first material having an acoustic impedance at one or more frequencies within the first frequency range that is substantially similar to an acoustic impedance of the wearer's skin at the one or more frequencies; and a second material on or near at least a second surface of the first transducer, the second material having an acoustic impedance at one or more frequencies within the first frequency range that substantially differs from an acoustic impedance of an environment of the device;

a microphone configured to receive from the wearer's body a reflected signal based on the generated signal:

one or more non-transitory computer-readable storage media embodying software: and one or more processors that are operable to execute the software to:

determine, based on the received reflected signal, a location of the device relative to at least one of the wearer's ears: and alter, based on the determined location, a frequency or an amplitude of the signal generated by the transducer.

2. The device of claim 1, wherein the environment comprises air.

3. The device of claim 1, wherein the first material conforms to a surface of the wearer's skin.

4. The device of claim 1, wherein the first frequency range includes one or more audible frequencies.

5. The device of claim 4, wherein the first frequency range comprises approximately 20 Hertz to approximately 20 kilohertz.

6. The device of claim 1, wherein the first frequency range includes one or more ultrasonic frequencies.

7. The device of claim 6, wherein the first frequency range comprises approximately 20 kilohertz to approximately 100 kilohertz.

8. The device of claim 6, wherein the first frequency range further includes one or more audible frequencies; and the signal comprises at least one ultrasonic carrier frequency modulated by the at least one audible frequency.

9. The device of claim 1, wherein the microphone is further configured to receive an environmental acoustic signal from an environment of the wearer.

10. The device of claim 9, wherein the environmental acoustic signal comprises a verbal communication from the wearer.

11. The device of claim 9, wherein the first transducer is configured to vibrate, based on the environmental acoustic signal, to generate the signal audible by the wearer of the device such that the signal destructively interferes with at least a portion of the environmental acoustic signal at the wearer.

12. The device of claim 1, wherein the one or more processors are further operable to execute the software to adjust;

a phase of the vibration.

13. The device of claim 1, wherein the first frequency range comprises at least one audible frequency and at least one ultrasonic frequency; and the one or more processors are operable to execute the software to alter, based on the determined location, the frequency of the vibration between the at least one audible frequency and the at least one ultrasonic frequency.

14. The device of claim 13, wherein the one or more processors are further operable to execute the software to:

determine a part of the wearer's body about which the device is worn; and adjust, based on the determined body part about which the device is worn, the frequency of the vibration between the at least one audible frequency and the at least one ultrasonic frequency.

15. The device of claim 1, wherein the one or more processors are further configured to execute the software to determine, based on the received reflected signal, a posture of the wearer.

16. The device of claim 15, wherein the one or more processors are further operable to execute the software to generate a notification to the wearer based on the determined posture.

17. The device of claim 1, wherein a vibration of the first transducer is based on one or more user-configurable settings.

18. The device of claim 17, wherein the user-configurable settings comprise an equalizer.

19. The device of claim 1, further comprising a global positioning system sensor.

20. The device of claim 1, further comprising a radio frequency transceiver.

21. The device of claim 1, wherein the first material comprises one or more of: a gel, a foam, a rubber, or a metal.

22. The device of claim 1, wherein the second material comprises one or more of:

a cotton and a plastic;

a cotton, a cork, and a rubber;

a vinyl and a polyurethane foam;

a soundproof foam; or a gel.

23. The device of claim 1 further comprising a third material enclosing the first transducer and the first material, wherein the third material comprises one or more of: a thin vinyl material, a thick vinyl material, an ultrasound gel pad, or a rubber casing.

24. The device of claim 1 wherein the device further comprises one or more of:

a counterbalanced neckband; or a tensioned headband.

25. The device of claim 1, wherein the device is configured to:

be placed into a neck pillow;

be placed inside a collar of an article of clothing;

be placed on a back of a helmet; or be embedded on a car seat neck support.

26. The device of claim 1, further comprising a second transducer configured to vibrate within a second frequency range, wherein the signal is based on the vibrations in the first frequency range and the vibrations in the second frequency range.

27. The device of claim 26, wherein the first frequency range includes one or more audible frequencies and the second frequency range comprises one or more ultrasonic frequencies.

28. The device of claim 26, wherein the first and second frequency ranges both include one or more audible frequencies.

29. The device of claim 28, wherein the signal comprises stereophonic sound.

30. The device of claim 1, wherein the signal audible by the wearer of the device is transmitted from the first transducer through an acoustic pathway comprising:

the first material on or near the first surface of the first transducer and coupled to the skin of the wearer of the device, the skin of the wearer, and a soft tissue of the wearer.

31. The device of claim 1, wherein the one or more processors are operable to execute the software to:

in response to a determination that the device is at least a predetermined distance away from the wearer's ear, vibrate the transducer at one or more ultrasonic frequencies; and in response to a determination that the device is within a predetermined distance away from the wearer's ear, vibrate the transducer at one or more audible frequencies.

32. A method comprising:

generating, by a transducer vibrating within a first frequency range, a signal audible by a wearer of a device;

substantially matching an acoustic impedance of the wearer's skin and an acoustic impedance of a first material on or near the transducer at one or more frequencies within the first frequency range; and substantially mismatching an acoustic impedance of an environment of the device and an acoustic impedance of a second material on or near the transducer at one or more frequencies within the first frequency range;

determining, based on a reflected signal that is based on the generated signal a location of the transducer relative to at least one of the wearer's ears: and determining, based on the determined location, a frequency or an amplitude at which to vibrate the transducer.

33. The method of claim 32, wherein the first material comprises one or more of: a gel, a foam, a rubber, or a metal.

34. The method of claim 32, wherein the second material comprises one or more of:

a cotton and a plastic;

a cotton, a cork, and a rubber;

a vinyl and a polyurethane foam;

a soundproof foam; or a gel.

35. A device comprising:

means for producing vibrations within a first frequency range to generate a signal audible by a wearer of the device through an acoustic pathway comprising:

means for transmitting the vibrations from the device to a skin of a wearer of the device;

means for impeding the vibrations from an environment of the device;

means for determining, based on a reflected signal that is based on the generated signal a location of the means for producing vibrations relative to at least one of the wearer's ears: and means for determining, based on the determined location, a frequency or an amplitude at which to produce the vibrations.

* * * * *